United States Patent [19]

Hüppi

[11] 4,036,610

[45] July 19, 1977

[54] RAPPING SHAFT DRIVE ASSEMBLY FOR ELECTROSTATIC PRECIPITATORS

[75] Inventor: Xaver Johann Hüppi, Zurich, Switzerland

[73] Assignee: Elex A.G., Zurich, Switzerland

[21] Appl. No.: 580,202

[22] Filed: May 23, 1975

[51] Int. Cl.[2] ..... B03C 3/76

[52] U.S. Cl. ..... 55/112; 55/300; 173/46

[58] Field of Search ..... 55/112, 300, 108; 173/46, 99

[56] References Cited

U.S. PATENT DOCUMENTS

| | | | |
|---|---|---|---|
| 2,702,090 | 2/1955 | Brown et al. | 55/112 |
| 2,864,459 | 12/1958 | Gustafsson | 55/112 |
| 3,173,773 | 3/1965 | Gustafsson | 55/112 |
| 3,183,648 | 5/1965 | Lagerdahl | 55/112 |
| 3,219,130 | 11/1965 | Steuernagel et al. | 55/112 X |

FOREIGN PATENT DOCUMENTS

| | | | |
|---|---|---|---|
| 583,594 | 10/1958 | Italy | 55/112 |

*Primary Examiner*—Frank W. Lutter
*Assistant Examiner*—David L. Lacey

[57] ABSTRACT

Rapping shaft drive assembly for electrostatic precipitators including a rotatably mounted isolator disposed between a rapping shaft and rapping shaft support means, the isolator including heat means therein and the support means including at least two rollers in communication only in points with the isolator whereby heat transmitted from the heated isolator to the rollers is minimized.

3 Claims, 2 Drawing Figures

RAPPING SHAFT DRIVE ASSEMBLY FOR ELECTROSTATIC PRECIPITATORS

BACKGROUND OF THE INVENTION

Figure 1:
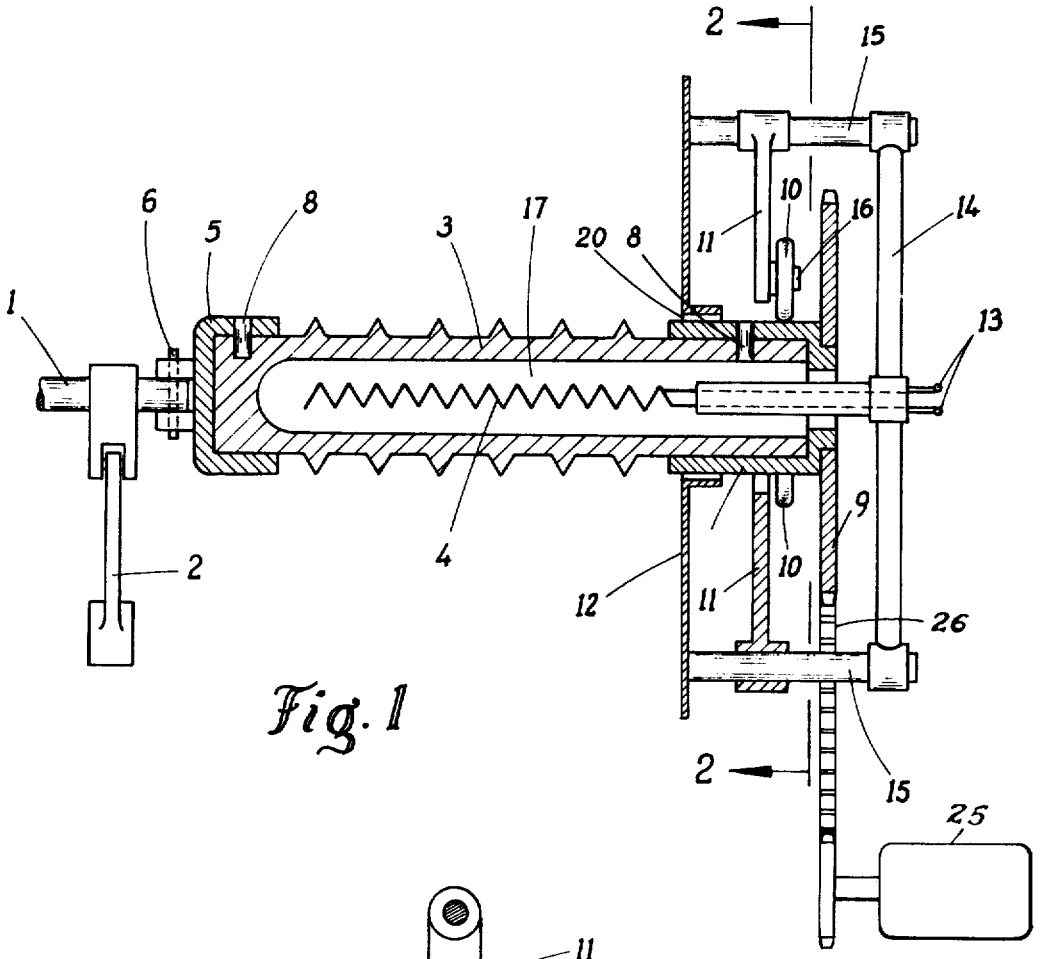

The present invention relates to a rapping shaft device assembly for electrostatic precipitators and more particularly relates to an isolater which is rotatably mounted and includes heat means therein, the support means for the isolator including a roller which has minimal contact with the isolator thereby minimizing the heat transfer from the isolator to the support means.

Electrostatic precipitators are provided with discharge and collecting electrodes which attract particulate matter from contaminated air streams passing therethrough. Particulate matter or dust which piles up on these electrodes must be removed by shaking or washing of these electrodes. Normally, the shaking is accomplished by vibrators or rapping devices. Generally, such devices have a rotating shaft with tumbling hammers fixed thereto and each of the hammers strikes a rapping rod linked to one or more discharge or collecting electrodes so as to shake or vibrate them. When the electrodes are under high tension, the rapping shaft must be isolated electrically from the drive outside the precipitator casing. Normally, this isolation is accomplished by an electrically isolating link which joins the hammer shaft and drive shaft together in one link. Inevitably, the isolator is placed inside the casing in the dust laden gases. Thus, part of the dust settles continuously upon the isolator and when the dust layer is wet by condensation of vapors, the high tension potential causes creeping currents or even flash overs thereby cracking the isolators. However, in order to prevent the vapor build up on the isolators the most common means of preventing this condensation build up is to heat the isolators so that the dust remains dry. This heating of the isolator can be made from outside by a heating element which reaches into a cavity in the isolator from the driving end or by heating the incoming air to the casing thereby keeping the environment within the casing at a temperature above the condensation point of the vapors which are passing therethrough. However, many difficulties have arisen in relation to gas temperatures in the range of 150° to 500° C. Firstly, the heat from inside the casing will be conducted by the isolator to the bearing of the isolator cap. When the bearing is heated up to 150° C or more, the lubricant will dry out, solidify, eventually carbonizing and jamming the cap to the bearing. In order to alleviate this problem the driving means have been electrically insulated from the rapping shaft by means of intermediate insulated couplings. Examples of these devices are noted in U.S. Pat. Nos. 2,864,459 and 3,173,773.

SUMMARY OF THE INVENTION

In the present invention it is recognized that it is desirable to provide a means for protecting rotatable support means for a rapper shaft of an electrostatic precipitator. Furthermore, it is recognized that it is desirable to provide a protective means for the bearings of a rapper shaft support means from the heat transmitted from an isolator disposed between the support means and the rapper shaft, the isolator having heat means therein.

According to the present invention, a rapping shaft is in communication with rapper shaft driving through an isolator, the isolator being in contact with support means so that the transmission of heat from the isolator to the support rollers having bearings is kept to a minimum thereby preventing the build up of heat at the bearings which in turn protects the lubricants against overheating and the consequences which result therefrom.

More particularly, the present invention provides in a rapping system for an electrostatic precipitator having a housing enclosing high voltage electrodes, a rapping shaft including hammer means operable to rap the discharge electrodes while energized, the housing having an opening in alignment with a rapping shaft drive assembly comprising: a rotatably mounted isolator projecting through the opening and in communication with the rapping shaft at one end and the drive means at the opposite end; the isolator including heat means therein whereby dust accumulating on the outer periphery thereof is kept above a preselected temperature; and, a drive means driving the isolator.

It is to be understood that the description of the examples of the present invention given hereinafter are not by way of limitation and various modifications within the scope of the present invention will occur to those skilled in the art upon reading the disclosure set forth hereinafter.

Figure 2:
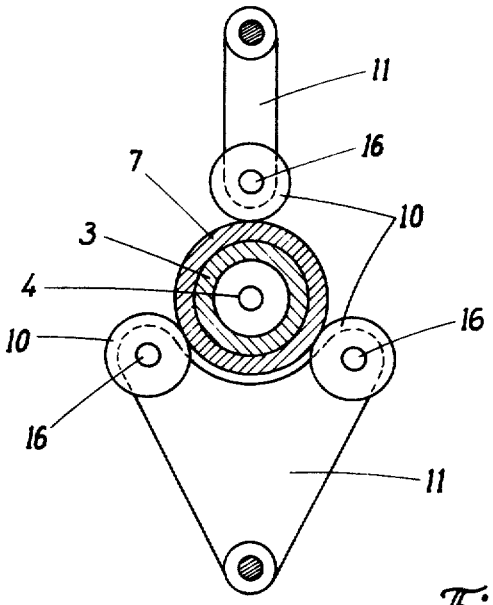

Referring to the drawing:

FIG. 1 is a sectional view illustrating a rotatable isolator, a drive shaft with hammers thereon, and drive means of the present invention; and, FIG. 2 is a sectional view taken along line 2—2 of FIG. 1.

In the accompanying drawing, in FIG. 1, an isolator 3 and a rapping shaft 1 are driven by a chain wheel 9, chain wheel 9 being driven by any known driving means, such as a variable speed motor, identified by the numeral 25 and a chain or belt 26. The isolator 3 is received by an outer cap 7 which is mounted onto the end thereof with a bolt 8 disposed through the cap 7 and into the side of the isolator 3 thereby locking the cap 7 onto the isolator 3. The cap 7 is preferably slidably mounted for easy insertion onto the isolator 3.

A wall 12 of the precipitator casing with an opening 20 therein is provided to separate the drive means from the heated electrostatic precipitator, opening 20 being provided to receive the cap 7 therethrough.

A second or inner cap 5 is mounted to the opposite end of the isolator 3 and a second bolt 8 is provided to extend through the cap 5 and into the isolator 3 thereby locking the cap 5 onto the isolator 3. The cap 5 is also preferably slidably mounted onto the isolator 3.

The cap 5 is provided with a coupling 6 which receives the shaft 1 therein in rotational movement upon movement of the isolator 3 in response to the driving means. Onto shaft 1 is mounted a plurality of hammers 2, the number of hammers 2 being carried by the shaft 1 is predetermined according to the number rows of electrodes in the precipitator.

At the drive end of the isolator 3 a collar plate 11 is provided, collar plate 11 receiving rollers 10 therein. Rollers 10, as best shown in FIG. 2, touch the cap 7 only in points whereby any heat that has been transmitted through the cap 7 from the isolator 3 in contact therewith transmits a minimal amount of heat from the isolator 3 to the rollers 10 and subsequently to the bearings 16 which are disposed for communication between the rollers 10 and the collar plate 11.

Collar plates 11 are supported by brackets 15 which are fixedly attached to the wall 12 in a transversely extending support 14, support 14 being disposed between the brackets 15. Support 14 is further provided as a support for the electrical conduit 13 which is in communication with the heating element 4, heating element 4 being disposed within a cavity 17 of the isolator 3. The heating element 4 is positioned and dimensioned to maintain a preselected temperature on the outer surface of the isolator 3 thereby preventing a build up of condensation on the isolator 3 during operation. The electrical conduit 13 is connected to an electrical source, not shown.

It will be realized that various changes may be made to the specific embodiment shown and described without departing from the principals and spirit of the present invention.

What is claimed is:

1. A rapping system for an electrostatic precipitator including a housing with a plurality of high voltage electrodes therein, said rapping system comprising: a rapping shaft with hammer means attached thereto operable to rap said electrodes while energized and a rapping shaft drive assembly, the housing having an opening in alignment with said rapping shaft drive assembly, said rapping shaft drive assembly including a rotatably mounted isolator connected to said rapping shaft at one end and a drive means at the opposite end; said isolator including heat means therein whereby dust accumulating on the outer periphery thereof is kept above a preselected temperature; and rotatable support means supporting the isolator, the support means including at least two support rollers including bearing means therein in communication only in points with said isolator such that heat transmitted from said heated isolator to said at least two rollers is minimized.

2. The rapping system of claim 1 wherein said rotatably mounted isolator includes a driving hub mounted onto the other end thereof, said driving hub being in contacting relationship with said rollers.

3. The rapping system of claim 1 wherein said rotatably mounted isolator includes a cavity therein and said heat means is disposed within said cavity.

* * * * *